US005090310A

United States Patent [19]

Motoe

[11] Patent Number: 5,090,310

[45] Date of Patent: Feb. 25, 1992

[54] STENCIL DISCHARGE APPARATUS

[75] Inventor: Katsuro Motoe, Tsuchiura, Japan

[73] Assignee: Riso Kagaku Corporation, Tokyo, Japan

[21] Appl. No.: 659,946

[22] Filed: Feb. 25, 1991

[30] Foreign Application Priority Data

Mar. 6, 1990 [JP] Japan ..... 2-52776

[51] Int. Cl.[5] ..... B41L 13/06

[52] U.S. Cl. ..... 101/114; 101/479; 101/116

[58] Field of Search ..... 101/114, 116, 117-120, 101/141, 142, 477, 479; 156/227, 474; 100/45, 80, 81; 53/116, 117

[56] References Cited

U.S. PATENT DOCUMENTS 4,339,293 7/1982 Takahashi et al. ..... 101/116
4,628,813 12/1986 Hasegawa et al. ..... 101/128.4
4,846,057 7/1989 Endo et al. ..... 101/477
4,926,749 5/1990 Neale et al. ..... 100/81

FOREIGN PATENT DOCUMENTS 115882 7/1984 Japan ..... 101/116

*Primary Examiner*—Edgar S. Burr
*Assistant Examiner*—Ren Yan
*Attorney, Agent, or Firm*—Kanesaka and Takeuchi

[57] ABSTRACT

In a mimeographic printing machine, a stencil discharge apparatus comprises a device for peeling a stencil from the outer circumferential surface of a rotary cylindrical drum, a rotary unit rotatably located near the peeling device, the rotary unit having a receiving portion opening backwardly with respect to the rotating direction of the rotary unit, and a disposal unit located near the rotary unit. The disposal unit has an introducing plate which is operable in response to the rotation of the rotary unit for compressing the stencil to discard.

7 Claims, 6 Drawing Sheets

STENCIL DISCHARGE APPARATUS

BACKGROUND OF THE INVENTION

1. Field of the Invention

This invention relates to a stencil discharge apparatus, in a mimeographic printing machine or the like, for compressing a used stencil to discard.

2. Description of the Related Art

A mimeographic printing machine is currently known which includes a rotary cylindrical drum supporting on its outer circumferential surface a stencil. Generally, in this type of conventional machine, an ink supply means is located inside the cylindrical drum, and the stencil is wound on the outer circumferential surface of an ink-penetrable tubular wall. During printing, a paper sheet is moved forwardly while being held between a press roller and the cylindrical drum as the latter is driven to rotate.

For discarding a used stencil upon completion of printing, the above-mentioned conventional mimeographic printing machine is equipped with a stencil discharge means composed of a peeling claw located near the cylindrical drum, take-up rollers and a disposal box. In use, an end of the used stencil is peeled from the circumferential surface of the cylindrical drum by the peel claw, and the partially peeled stencil is further peeled off the cylindrical drum by winding on the take-up rollers, whereupon the completely peeled stencil is directly pushed into the disposal box.

With this conventional stencil discharge means, since the used stencil is pushed into the disposal box by the take-up rollers which peels the stencil from the cylindrical drum, the force of compressing the discarded stencil within the disposal box was inadequate. When many discarded stencils have been accumulated in the disposal box, the discarded stencils would tend to be entangled on the take-up rollers.

SUMMARY OF THE INVENTION

It is therefore an object of this invention to provide a stencil discharge apparatus in which the used stencil can be compressed adequately and can be prevented from being entangled on the nearby parts or elements.

According to this invention, there is provided a stencil discharge apparatus for a mimeographic printing machine having a rotary cylindrical drum for supporting on its outer circumferential surface a stencil, the apparatus comprising: means for peeling the stencil from the outer circumferential surface of the rotary cylindrical drum; a rotary unit rotatably located near the peeling means, the rotary unit having a receiving portion opening backwardly with respect to the rotating direction of the rotary unit; and a disposal unit located near the rotary unit, the disposal unit having an introducing plate which is operable in response to the rotation of the rotary unit for compressing the stencil to discard.

With this arrangement, the stencil peeled from the cylindrical drum by the peeling means is pushed into the receiving portion of the rotary unit. As the rotary unit is rotated, the stencil in the receiving portion is compressed there by the introducing plate of the disposal unit, and subsequently, the stencil is discharged from the receiving portion into the disposal unit.

Preferably the rotary unit is composed of a plurality of rotary members fixedly mounted on a common rotary shaft at equal angular distances, each of the rotary members having the receiving portion.

The disposal unit has upper and lower introducing plates projecting into each of spaces between the rotary members. The disposal unit further has therein a compressing plate for further compressing the once compressed stencil.

The above and other advantages, features and additional objects of this invention will be manifest to those versed in the art upon making reference to the following detailed description and the accompanying drawings in which a preferred structural embodiment incorporating the principles of this invention is shown by way of illustrative example.

DETAILED DESCRIPTION

Figure 1:
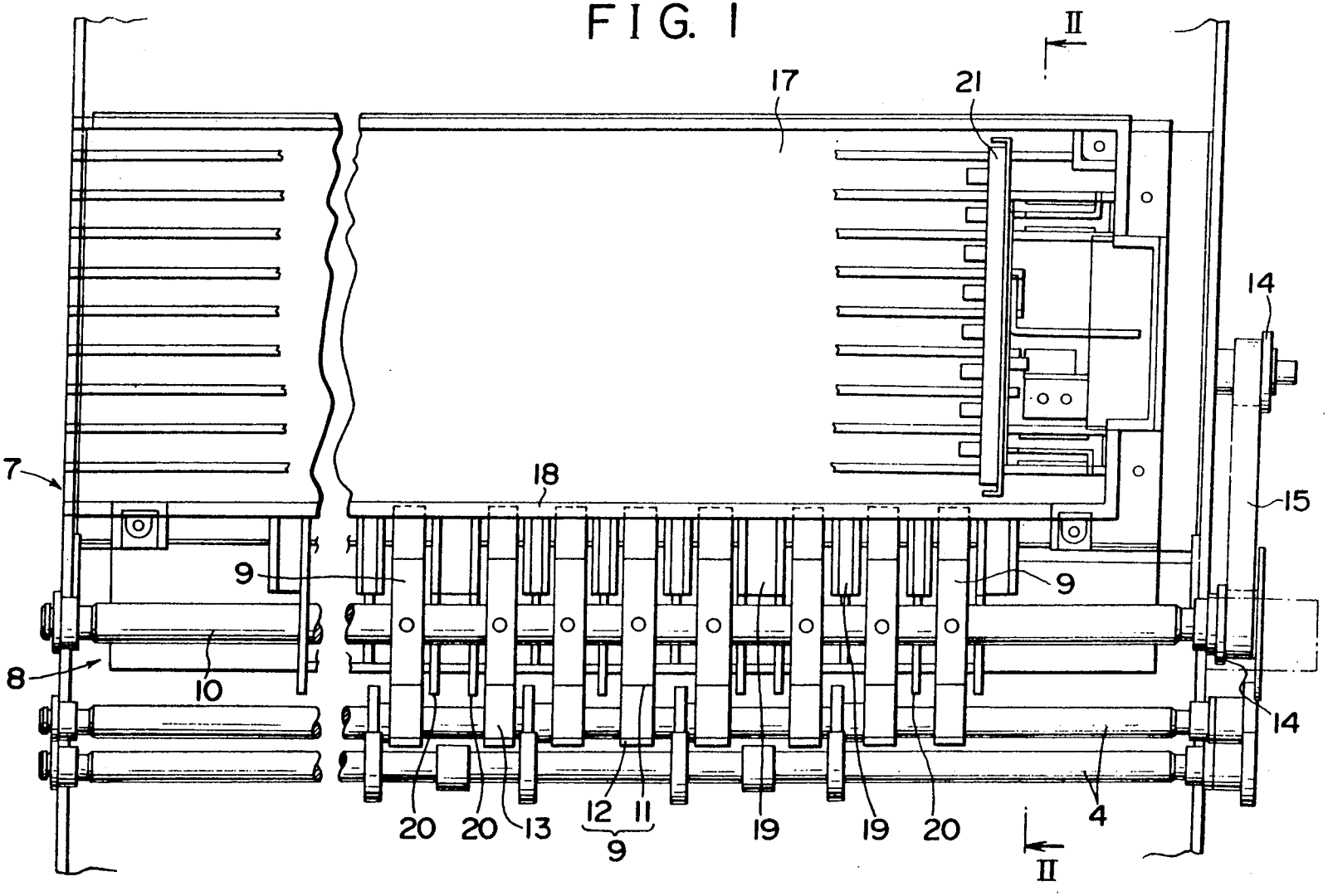
FIG. 1 is a plan view, with parts omitted, of a stencil discharge apparatus embodying this invention.
Figure 2:
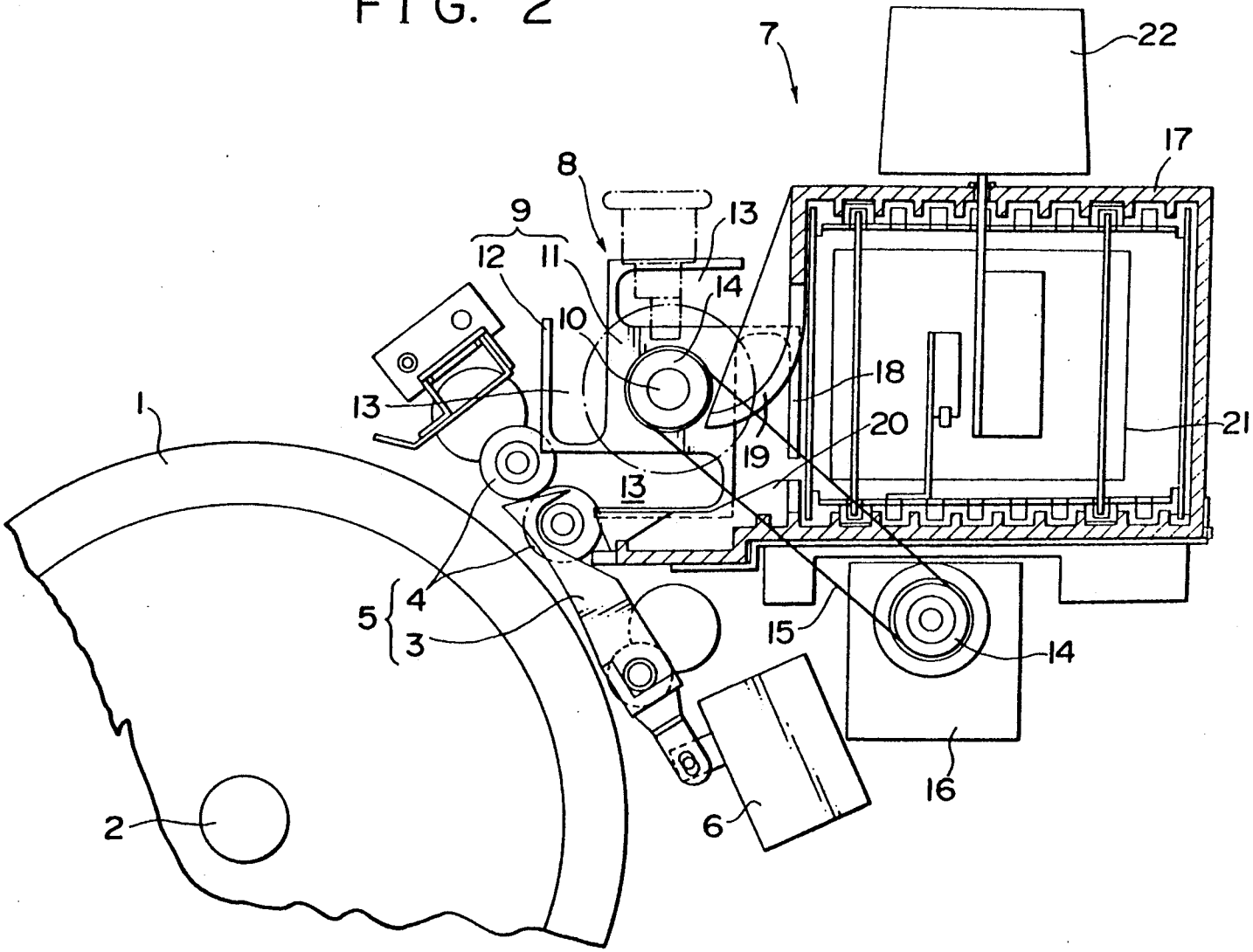
FIG. 2 is a transverse cross-sectional view taken along line II—II of FIG. 1.

FIGS. 1 and 2 show one embodiment of a stencil discharge apparatus for a mimeographic printing machine, generally designated by the numeral 7.

In FIGS. 1 and 2, reference numeral 1 designates a rotary cylindrical drum to be driven for rotation about a shaft 2. On the outer circumferential surface of the cylindrical drum 1, a stencil is to be wound.

Adjacent to the cylindrical drum 1, a peeling means 5 composed of a peeling claw 3 and take-up rollers 4 are located. The peeling claw 3 is driven by a solenoid 6; a distal end of the peeling claw 3 peels the end of the stencil S from the outer circumferential surface of the cylindrical drum 1 to guide the peeled end of the stencil to the take-up rollers 4. The take-up rollers 4 move the stencil forwardly to remove the stencil from the cylindrical stencil 1.

Adjacent to the take-up rollers 4, a rotary unit 8 of the stencil discharge apparatus is located. This rotary unit 8 is composed of a plurality of rotary members 9 fixedly mounted on a common shaft 10 at equal angular spaces. The rotary unit 8 having the four rotary members 9 includes a substantially square base 11, and four cantilevered arms 12 projecting from the respectively four sides of the square base 11. Each arm 12 and the base 11 defines a receiving portion 13 for receiving the stencil. Specifically, the receiving portion 13 is opening backwardly in the rotating direction of the rotary unit 8 to receive the stencil from the take-up rollers 4. The shaft 10 is operatively connected to a motor 16 via two pulleys 14, 14 and an endless belt 15 so that the rotary members 9 with the receiving portions opening backwardly are angularly moved at a predetermined timing.

A disposal box 17 as a discard unit is located near the rotary unit 8. On the front surface of the disposal box 17 confronting with the rotary unit 8, an inlet 18 extends longitudinally of the rotary unit 8 and has a length longer than the width of the stencil. A plurality of penthouse-like introducing plates 19 are located above the inlet 18 at equal spaces, projecting from that location. One or more introducing plate 20 corresponding to the respective introducing plate(s) 19 projects from a position below the inlet 18. These lower introducing plates 20 extend to the position below the rotary unit 8. These introducing plates 19, 20 are projecting toward the front surface of the disposal box 17 and are located in the spaces between the rotary members 9 so as not to contact them. In other words, the introducing members 19 of the rotary unit 8 and the introducing members 20 of the discharge box 17 are received between the adjacent introducing members so as not to interfere each other.

A compressing plate 21 is longitudinally slidably received inside the disposal box 17. This compressing plate 21 has a lever 22 so that the compressing plate 21 can be operated from outside of the disposal box 17 to compress the stencil within the disposal box 17.

The operation of the above-discussed stencil discharge apparatus will now be described with reference to FIGS. 3 through 10.

Figure 3:
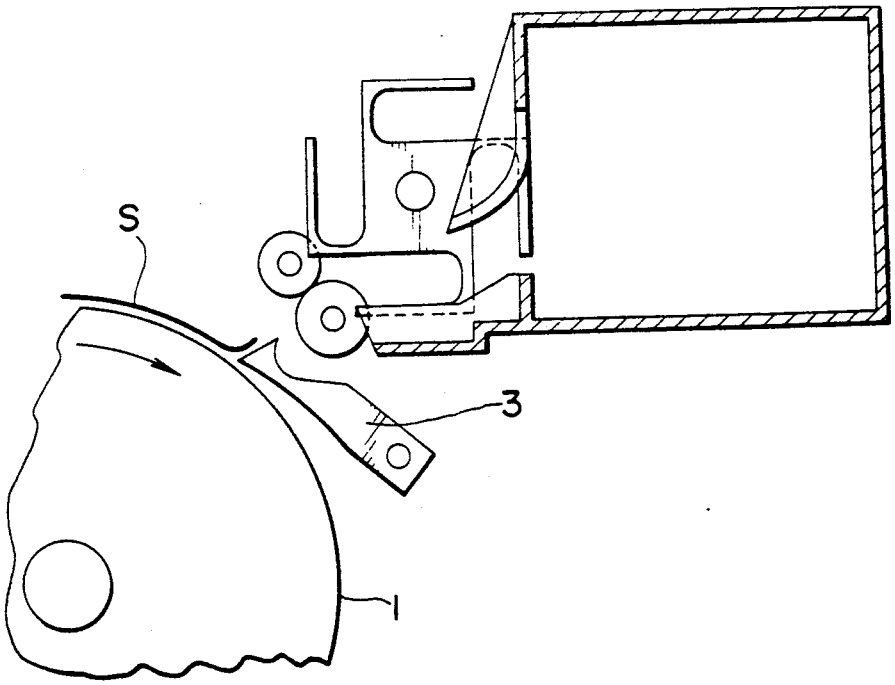
FIGS. 3 through 10 show the manner in which the used stencil is discharged.
Figure 4:
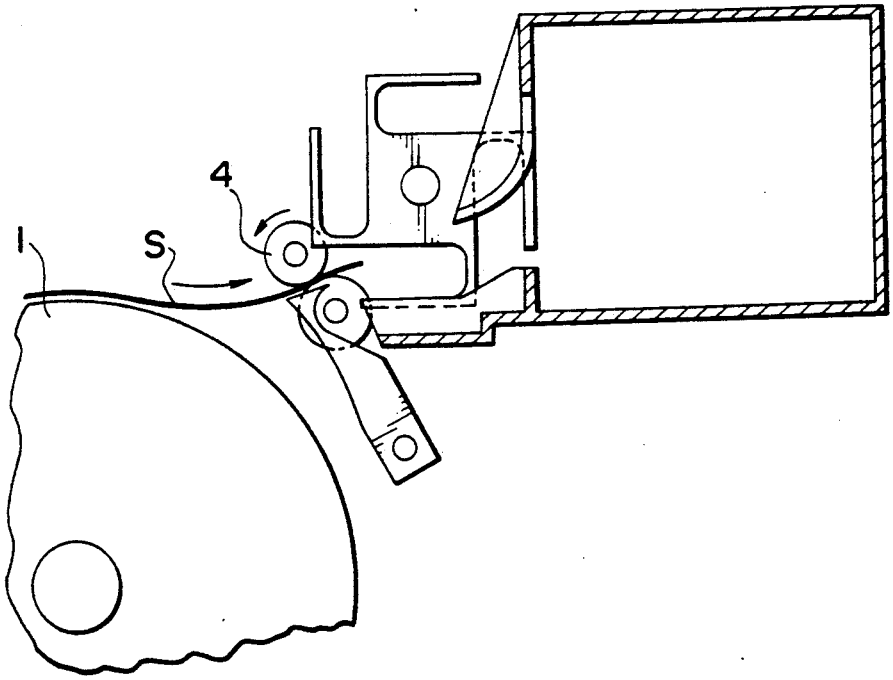

As shown in FIG. 3, the peeling claw 3 peels the end of the stencil S from the outer circumferential surface of the cylindrical drum 1. As shown in FIG. 4, the stencil S is guided by the take-up rollers 4 and is moved thereby, being gradually removed from the cylindrical drum 1. Then as shown in FIG. 5, the stencil S is temporarily received in the receiving portion 13 of the rotary unit 8 by the take-up rollers 4, and takes a compressed posture.

Figure 6:
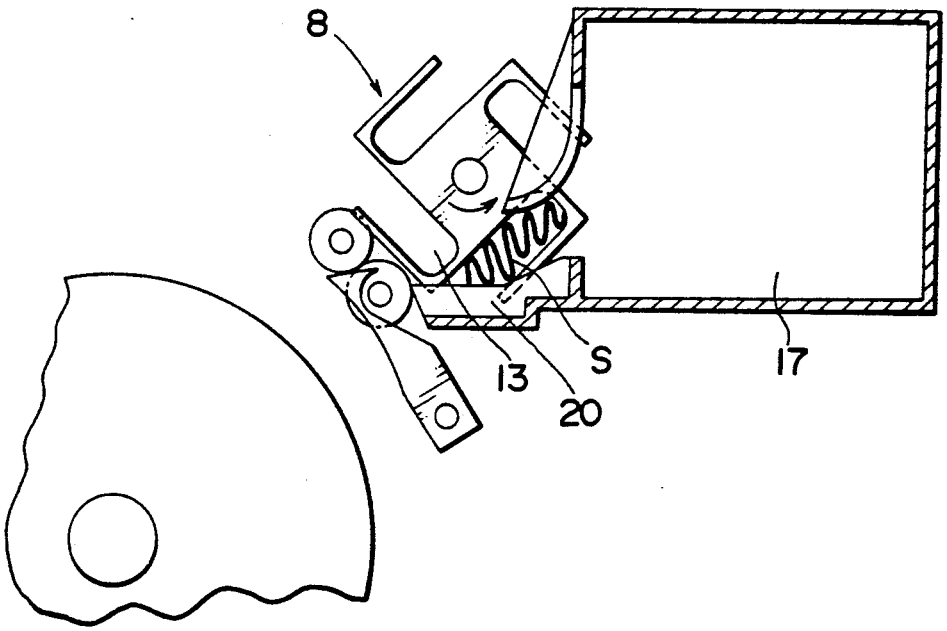

In FIG. 6, rotary unit 8 is angularly moved in such a direction that the individual receiving portion 13 opens backwardly in the rotating direction of the rotary unit 8. The stencil S is conveyed toward the disposal box 17 as guided by the extension of the lower introducing plate 20 and held in the receiving portion 13.

Figure 7:
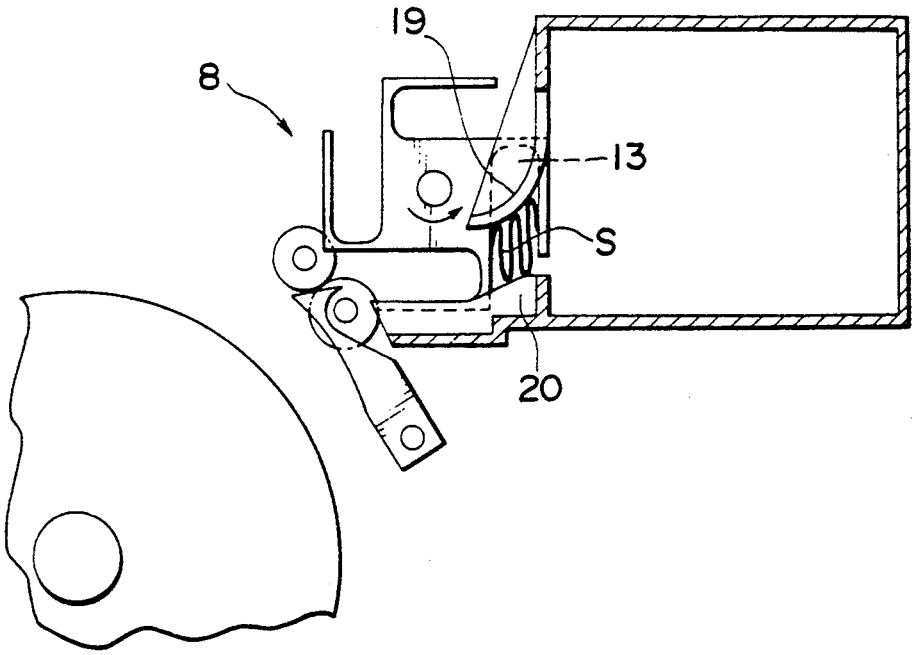

In FIG. 7, due to the rotation of the rotary unit 8, the stencil S in the receiving portion 13 is compressed by the upper introducing plate 19 and is additionally compressed between the upper and lower introducing plates 19, 20.

Figure 5:
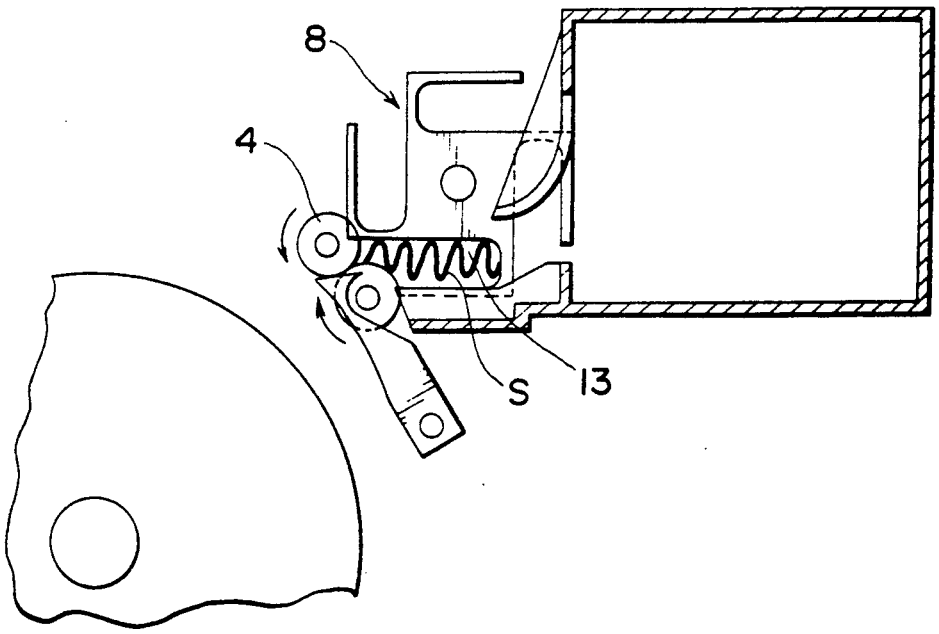
Figure 8:
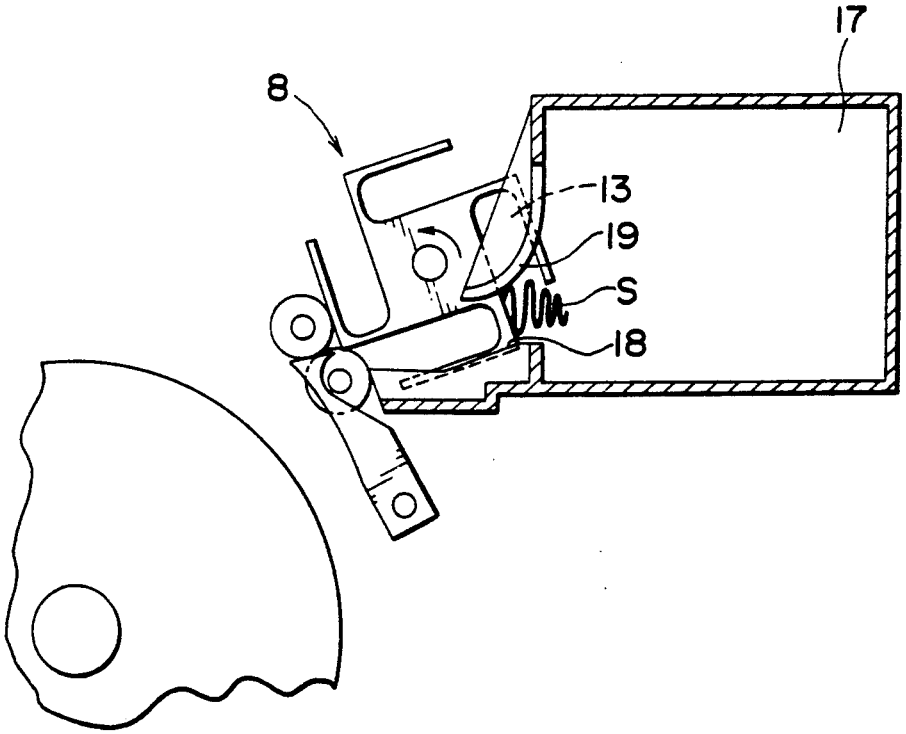
Figure 9:
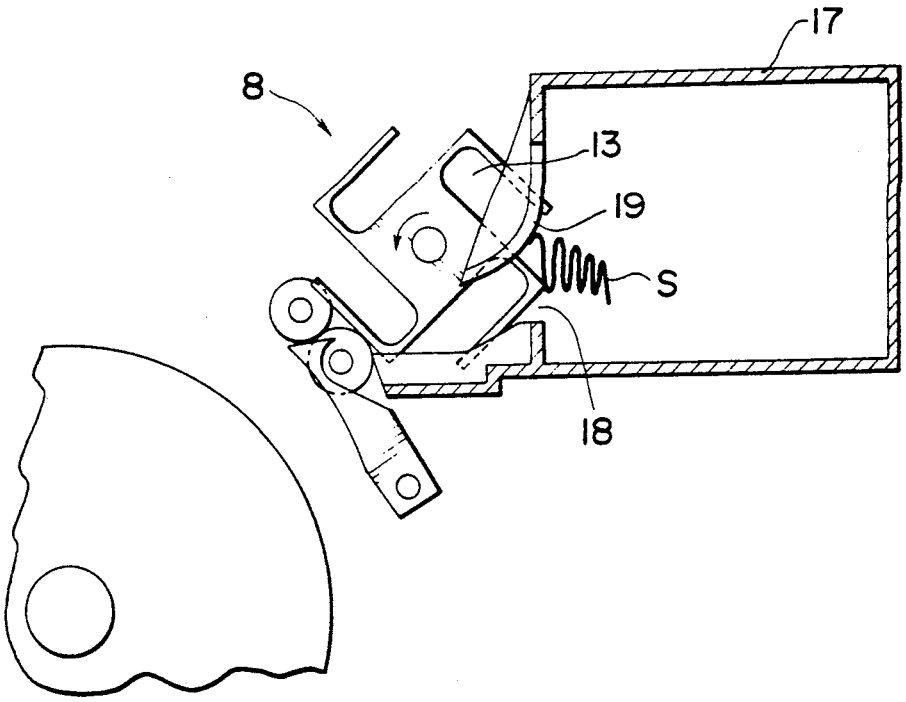
Figure 10:
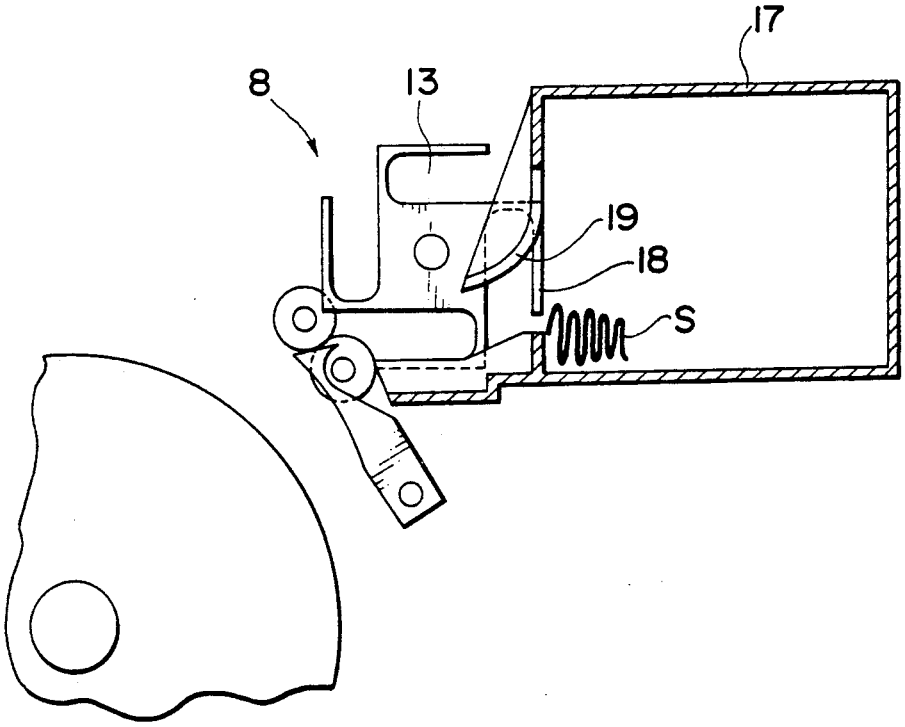

As shown in FIGS. 8 through 10, with continued angular movement of the rotary unit 8 through 180° from the position of FIG. 5, the compressed stencil S is discharged from the receiving portion 13 as pushed by the upper introducing plate 19. Then the discharged stencil S is discarded into the disposal box 17 from the inlet 18.

Though there is no illustration in the accompanying drawings, when some number of the discarded stencils have accumulated in the disposal box 17, the compressing plate 21 is operated by the lever 22 to press these stencils to a compact size, whereupon the compacted stencils are pushed into a non-illustrated vinyl bag or corrugated cardboard box for disposal.

According to the illustrated embodiment, the stencil S forced into the receiving portion 13 of the rotary unit 8 is further compressed by the rotating force of the rotary unit 8 and is then put into the disposal box 17. Therefore, compressing can take place adequately so that a large number of used stencils can be received in the disposal box 17. Further, the thus compacted discharged stencils would hardly be caught by the take-up rollers 4.

In the illustrated embodiment, since the rotary unit 8 is angularly moved by 180° for every discharging operation, only two of the four receiving portions 13 can be used. Therefore, this embodiment should have required at least two receiving portions 13. Alternatively, the rotary unit 8 may be angularly moved through 90° for every discharging operation, so all of the four receiving portions 13 can be used. In another alternative way, if the rotary unit 8 makes a complete rotation, i.e., through 360° for every discharging operation, it requires only one receiving portion.

According to this invention, with the stencil pushed into the receiving portion of the rotary unit, the rotary unit is rotated or angularly moved to compress the stencil in the receiving portion by the introducing plate of the disposal box. It is therefore possible to compress the stencil adequately so that the discharged stencil would hardly be caught by the take-up rollers, which are located on the side toward the cylindrical drum.

What is claimed is:

1. A stencil discharge apparatus for a mimeographic printing machine having a rotary cylindrical drum for supporting a stencil on an outer circumferential surface, said apparatus comprising:

means for peeling the stencil from the outer circumferential surface of the rotary cylindrical drum, means for transferring the stencil peeled by the peeling means in the direction away from the rotary cylindrical drum, said transferring means being situated near the peeling means, a rotary unit rotatably situated near the transferring means at a side opposite to the peeling means, said rotary unit having a receiving portion facing the transferring means so that when the transferring means transfers the stencil, the stencil is forcibly entered into the receiving portion to thereby compress and squeeze the stencil inside the receiving portion, and a disposal unit situated near the rotary unit and having an introducing plate, said introducing plate, when the rotary unit is rotated, engaging the compressed stencil retained in the receiving portion and guiding the compressed stencil from the receiving portion to enter into the disposal unit so that the compressed stencil is kept in the disposal unit.

2. A stencil discharge apparatus according to claim 5, wherein said rotary unit is composed of a plurality of rotary members fixedly mounted on a common rotary shaft at equal angular distances, each of said rotary members having said receiving portion.

3. A stencil discharge apparatus according to claim 2, wherein said disposal unit has upper and lower introducing plates projecting into each of spaces between said rotary members.

4. A stencil discharge apparatus according to claim 5, wherein said disposal unit further has therein a compressing plate for further compressing the once compressed stencil.

5. A stencil discharge apparatus according to claim 1, wherein said introducing plate is positioned relative to the rotary unit so that when the rotary unit is rotated, the compressed stencil retained in the receiving portion is discharged from the receiving portion while the compressed stencil is further compressed inside the receiving portion by the introducing plate.

6. A stencil discharge apparatus according to claim 1, wherein said transferring means is formed of a pair of rollers, said rollers removing the stencil from the cylindrical drum and forcibly disposing the stencil into the receiving portion of the rotary units.

7. A stencil discharge apparatus according to claim 1, wherein said transferring means is actuated in case the rotary unit is stopped and the receiving portion faces the transferring means, said rotary unit being rotated after the used stencil is completely supplied to the receiving portion.

* * * * *